US005781644A

United States Patent [19]

Chang

[11] Patent Number: 5,781,644

[45] Date of Patent: Jul. 14, 1998

[54] PICK-UP DEVICE FOR A MICROPHONE

[76] Inventor: Ching-Lu Chang, No. 39, Lane 29, Shih-Chia Rd., Tung Dist., Taichung City, Taiwan

[21] Appl. No.: 879,547

[22] Filed: Jun. 20, 1997

[51] Int. Cl.[6] ..... H04R 25/00

[52] U.S. Cl. ..... 381/177; 381/168; 381/169

[58] Field of Search ..... 381/199, 168, 381/169, 192, 155, 177

[56] References Cited

U.S. PATENT DOCUMENTS

| | | | |
|---|---|---|---|
| 2,293,078 | 8/1942 | Proctor | 381/177 |
| 3,536,863 | 10/1970 | Schenkel | 381/155 |
| 3,585,317 | 6/1971 | Dvorsky | 381/155 |
| 4,199,667 | 4/1980 | Renner | 381/194 |
| 5,590,211 | 12/1996 | Chang | 381/199 |
| 5,706,359 | 1/1998 | Chang | 381/168 |

FOREIGN PATENT DOCUMENTS

| | | | |
|---|---|---|---|
| 0096796 | 7/1980 | Japan | 381/177 |

*Primary Examiner*—Sinh Tran

*Attorney, Agent, or Firm*—Harness, Dickey & Pierce, P.L.C.

[57] ABSTRACT

A pick-up device includes a front cover, a diaphragm incorporating a voice coil disposed posteriorly of the front cover, a front flux shield plate disposed posteriorly of the diaphragm and having a first hole, a magnet disposed at a back side of the front flux shield plate and having a second hole aligned with the first hole, a yoke disposed around the front flux shield plate and the magnet and confining a first air passage with both the front flux shield plate and the magnet, a rear flux shield plate disposed at the back sides of the magnet and the yoke and having a threaded third hole which is aligned with the second hole, the rear flux shield plate further having a second air passage which is communicated with the first air passage, an encapsulation to encompass the yoke and the rear flux shield plate, a rear cap to encompass the encapsulation and the rear flux shield plate, a screw rod passing through the rear cap and threadedly engaged with the third hole, thereby closing the third hole, and a high frequency resonance pad provided in front of the front flux shield plate and having a securing portion which extends into at least the first and second holes, the high frequency resonance pad being formed via an in-situ forming process.

4 Claims, 4 Drawing Sheets

PICK-UP DEVICE FOR A MICROPHONE

BACKGROUND OF THE INVENTION

1. Field of the Invention

The present invention relates to a pick-up device for a microphone, more particularly to a pick-up device which is capable of significantly reducing the presence of static noise.

2. Description of the Related Art

Referring to FIG. 1, a conventional pick-up device 2 for a microphone is shown to include a main body 2*a*, a washer 2*b*, a plastic outer ring 2*c*, a rear cap 2*d*, a voice coil 2*e*, a diaphragm 2*f*, a protective cover 2*g*, a sound regulating paper 2*h*, a housing 2*i* and a sound pressure regulating rod 2*j*. Referring to FIG. 2, during the fabrication of the pick-up device 2, a magnet 2*a*1 and a yoke iron 2*a*2 are placed in a mold (not shown), and a first injection molding process is performed to form a plastic inner ring 2*a*3 therebetween. The inner ring 2*a*3 has a plurality of sound regulating holes 2*a*4 formed at a periphery thereof. The inner ring 2*a*3 is joined with the magnet 2*a*1 and the yoke iron 2*a*2 to form an integral main body 2*a*. A high frequency resonance pad 2*k* is adhered to a front side of the magnet 2*a*1. The main body 2*a* and the washer 2*b* are then placed in another mold, and a second injection molding process is performed to form the plastic outer ring 2*c* around the main body 2*a* and the washer 2*b*.

Since the outer ring 2*c* and the rear cap 2*d* are made of a low density plastic material and are incapable of isolating external vibrations, vibrations can thus be transmitted therethrough to the voice coil 2*e* and the diaphragm 2*f*. Significant noise in the low frequency range thus results. Moreover, the high frequency resonance pad 2*k* is liable to drop off from the magnet 2*a*1 since it is attached to the magnet 2*a*1 by mere use of an adhesive. The conventional pick-up device 2 is therefore unsatisfactory.

SUMMARY OF THE INVENTION

The main object of the present invention is to provide a microphone pick-up device for solving the aforementioned problems of ease of removal of the high frequency resonance pad and the presence of significant noise.

Accordingly, the microphone pick-up device of the present invention includes a front cover, a diaphragm incorporating a voice coil disposed posteriorly of the front cover, a front flux shield plate disposed posteriorly of the diaphragm and having a first hole substantially at the center thereof, a magnet disposed at a back side of the front flux shield plate and having a second hole aligned with the first hole, a yoke disposed around and spaced apart from both the front flux shield plate and the magnet and confining a first air passage with both the front flux shield plate and the magnet, a rear flux shield plate disposed at the back sides of the magnet and the yoke and having a third hole which is aligned with the second hole and which is threaded, the rear flux shield plate further having a second air passage which is radially spaced apart from the third hole and which is communicated with the first air passage, an encapsulation to encompass the yoke and the rear flux shield plate, a rear cap disposed posteriorly of the rear flux shield plate and having surrounding wall parts which project forwardly to encompass the encapsulation and the rear flux shield plate, a screw rod passing through the rear cap and having a front end threadedly engaged with the third hole, thereby closing the third hole, and a high frequency resonance pad provided in front of the front flux shield plate and having a securing portion which extends into at least the first and second holes, the high frequency resonance pad being formed via an in-situ forming process.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
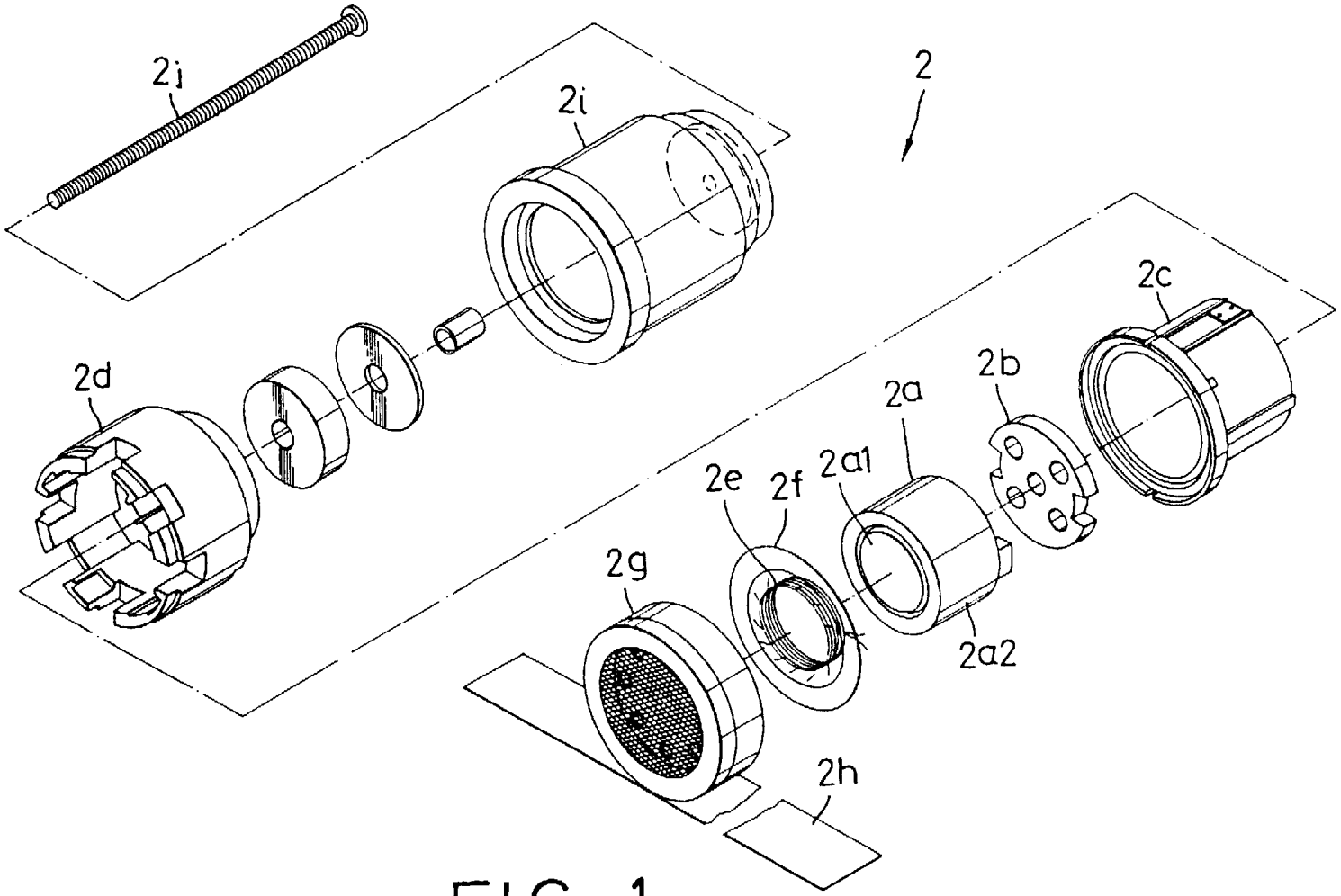
FIG. 1 PRIOR ART
FIG. 1 is an exploded perspective view of a conventional pick-up device for a microphone.
Figure 2:
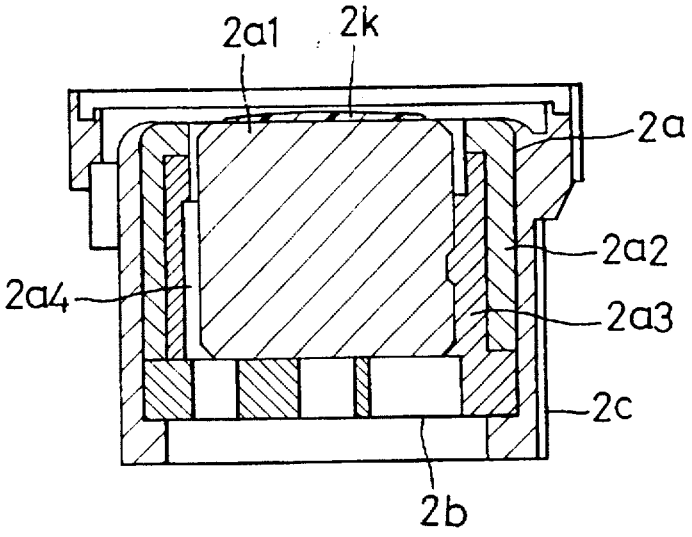
FIG. 2 PRIOR ART
FIG. 2 is a sectional view of a part of the pick-up device of FIG. 1.
Figure 3:
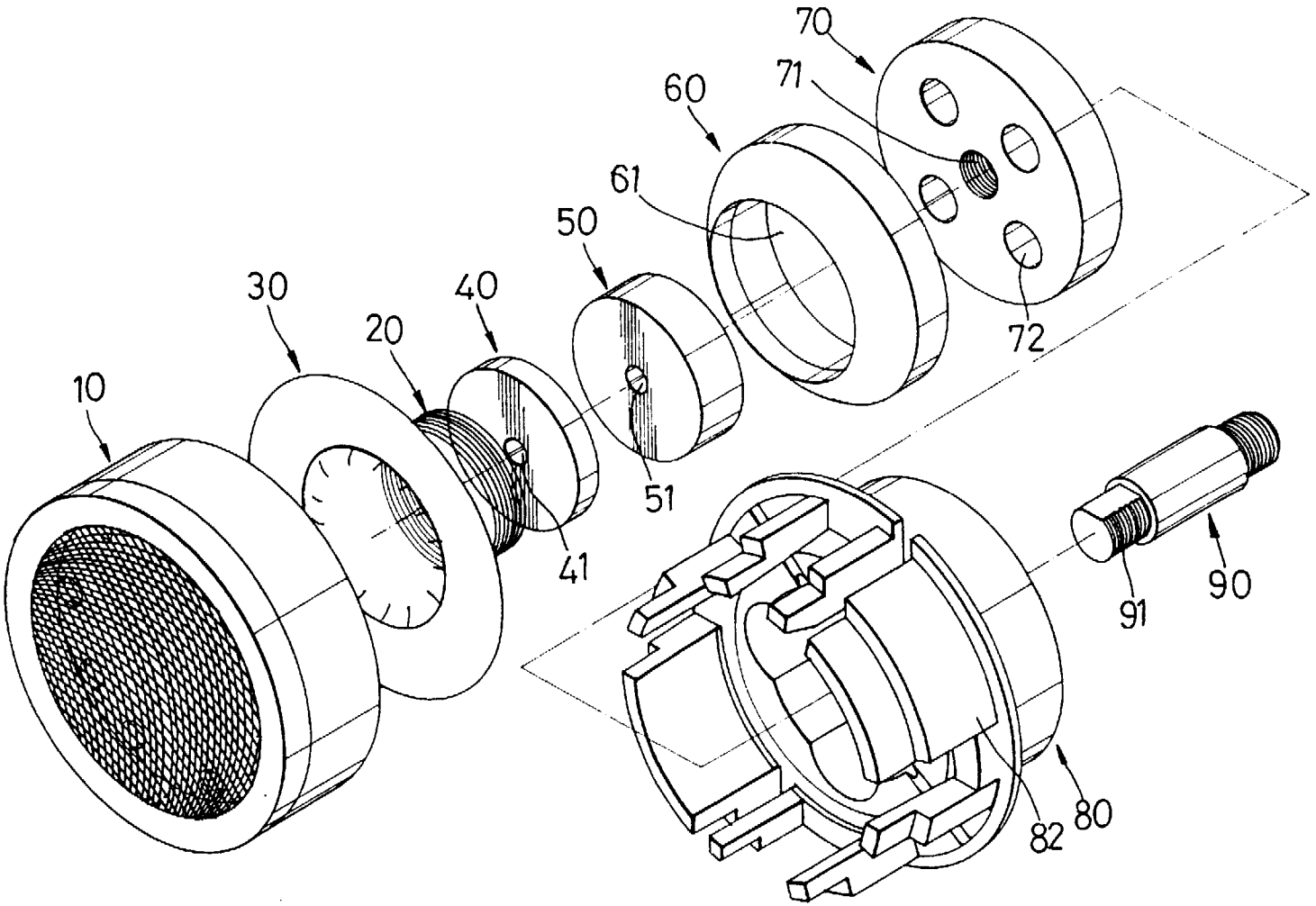
FIG. 3 is an exploded perspective view of a microphone pick-up device according to a preferred embodiment of the present invention before an encapsulation and a high frequency resonance pad are formed.
Figure 4:
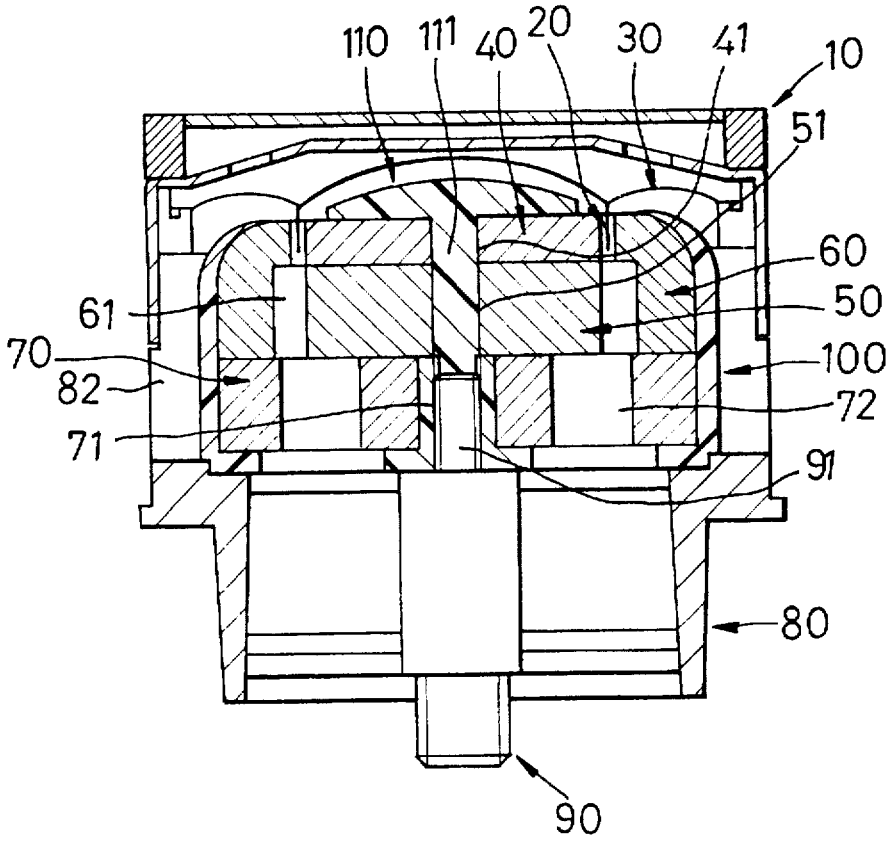
FIG. 4 is a sectional view of the pick-up device of the preferred embodiment.

Referring to FIGS. 3 and 4, the microphone pick-up device according to the preferred embodiment of the present invention is shown to include a front cover 10, a diaphragm 30 incorporating a voice coil 20, a front flux shield plate 40, a magnet 50, a yoke 60, a rear flux shield plate 70, an encapsulation 100, a rear cap 80, a screw rod 90 and a high frequency resonance pad 110.

The diaphragm 30 and the voice coil 20 are disposed posteriorly of the front cover 10. The front cover 10, the diaphragm 30 and the voice coil 20 are similar to those of the conventional pick-up device and will not be detailed further. The front flux shield plate 40 is disposed posteriorly of the diaphragm 30 and has a first hole 41 substantially at the center thereof. The magnet 50 is disposed at a back side of the front flux shield plate 40 and has a second hole 51 aligned with the first hole 41. The yoke 60 is disposed around and is spaced apart from both the front flux shield plate 40 and the magnet 50. The yoke 60 confines a first air passage 61 with both the front flux shield plate 40 and the magnet 50. The rear flux shield plate 70 is disposed at the back side of the magnet 50 and the yoke 60. The rear flux shield plate 70 has a third hole 71 which is aligned with the second hole 51 and which is threaded. The rear flux shield plate 70 further has four passage holes which serve as a second air passage 72. The second air passage 72 is radially spaced apart from the third hole 71 and is communicated with the first air passage 61 of the yoke 60. The encapsulation 100 is provided to encompass the yoke 60 and the rear flux shield plate 70. The rear cap 80 is generally annular in shape and is made of cast metal. The rear cap 80 is disposed posteriorly of the rear flux shield plate 70 and has surrounding wall parts 82 which project forwardly to encompass the encapsulation 100 and the rear flux shield plate 70. The screw rod 90 passes through the rear cap 80 and has a front end 91 threadedly engaging the third hole 71 of the rear flux shield plate 70, thereby closing the third hole 71. The high frequency resonance pad 110 is provided in front of the front flux shield plate 40 and has a securing portion 111 which extends into at least the first and second holes 41, 51.

To produce the pick-up device of the present embodiment, the front flux shield plate 40, the magnet 50, the yoke 60, the rear flux shield plate 70, the rear cap 80 and the screw rod 90 are assembled as follows. The front end portion 91 of the screw rod 90 is mounted threadedly to the third hole 71 of the rear flux shield plate 70. The yoke 60 is then superimposed on the rear flux shield plate 70. The magnet 50 is placed within the yoke 61 so that it is in contact with a central part of the rear flux shield plate 70. The front flux shield plate 40 is then superimposed on the magnet 50. The rear cap 80 is disposed posteriorly of the rear flux shield plate 70 such that the surrounding wall parts 82 thereof are located around the rear flux shield plate 70 and the yoke 60. Thereafter, the resulting assembly is placed in predetermined upper and lower molds (not shown) to perform an in-situ injection molding process, thereby forming the encapsulation 100 and the high frequency resonance pad 110, which are made of plastic, at the same time. The encapsulation 100 and the high frequency resonance pad 110 can thus join the assembly into an integral body. Finally, the diaphragm 30, the voice coil 20 as well as the front cover 10 are provided on the integral body to form the pick-up device.

Accordingly, the pick-up device of the present invention with a metal rear cap 80, which has a material density significantly higher than that of plastic, is capable of effectively isolating external vibrations, thereby significantly reducing the presence of static noise in the low frequency range. Moreover, since the high frequency resonance pad 110 is formed via an in-situ forming process, it can be attached securely to the front flux shield plate 40. The pick-up device of the present embodiment is thus capable of generating high-quality sound both in the high frequency and low frequency ranges.

With this invention thus explained, it is apparent that numerous modifications and variations can be made without departing from the scope and spirit of this invention. It is therefore intended that this invention be limited only as indicated in the appended claims.

I claim:

1. A pick-up device for a microphone, comprising:

a front cover;

a diaphragm incorporating a voice coil disposed posteriorly of said front cover;

a front flux shield plate disposed posteriorly of said diaphragm and having a first hole substantially at the center thereof;

a magnet disposed at a back side of said front flux shield plate and having a second hole aligned with said first hole;

a yoke disposed around and spaced apart from both said front flux shield plate and said magnet and confining a first air passage with both said front flux shield plate and said magnet;

a rear flux shield plate disposed at the back sides of said magnet and said yoke and having a third hole which is aligned with said second hole and which is threaded, said rear flux shield plate further having a second air passage which is radially spaced apart from said third hole and which is communicated with said first air passage;

an encapsulation to encompass said yoke and said rear flux shield plate;

a rear cap disposed posteriorly of said rear flux shield plate and having surrounding wall parts which project forwardly to encompass said encapsulation and said rear flux shield plate;

a screw rod passing through said rear cap and having a front end threadedly engaged with said third hole, thereby closing said third hole; and a high frequency resonance pad provided in front of said front flux shield plate and having a securing portion which extends into at least said first and second holes, said high frequency resonance pad being formed via an in-situ forming process.

2. A pick-up device as claimed in claim 1, wherein said high frequency resonance pad and said encapsulation are formed at the same time.

3. A pick-up device as claimed in claim 1, wherein said high-frequency resonance pad and said encapsulation are made of plastic.

4. A pick-up device as claimed in claim 1, wherein said rear cap is made of metal.

* * * * *